US009187943B2

(12) United States Patent
Leone et al.

(10) Patent No.: US 9,187,943 B2
(45) Date of Patent: Nov. 17, 2015

(54) ROTARY DAMPER

(71) Applicant: MORI SEIKI CO., LTD., Nara (JP)

(72) Inventors: Chris Leone, Boulder, CO (US); Stefan Neu, El Dorado Hills, CA (US)

(73) Assignee: DMG MORI SEIKI CO., LTD., Nara (JP)

( * ) Notice: Subject to any disclaimer, the term of this patent is extended or adjusted under 35 U.S.C. 154(b) by 202 days.

(21) Appl. No.: 13/958,109

(22) Filed: Aug. 2, 2013

(65) Prior Publication Data

US 2015/0033501 A1 Feb. 5, 2015

(51) Int. Cl.
*E05F 5/10* (2006.01)
*E05F 5/02* (2006.01)

(52) U.S. Cl.
CPC .... *E05F 5/10* (2013.01); *E05F 5/02* (2013.01)

(58) Field of Classification Search
CPC ..... E05F 3/00; E05F 3/14; E05F 5/00; E05F 5/10; E05F 17/001; E05F 17/002; E05F 17/004; E05F 2017/008; E05F 3/222; E05F 3/227
USPC ..... 74/53–56, 122, 567, 569, 813 L, 838, 74/816; 16/50, 53, 63, 72, 312
See application file for complete search history.

(56) References Cited

U.S. PATENT DOCUMENTS

| | | | | |
|---|---|---|---|---|
| 1,504,517 | A * | 8/1924 | Schnitzler | 16/70 |
| 2,757,949 | A * | 8/1956 | Delany | 292/1 |
| 3,230,611 | A * | 1/1966 | Moore | 29/596 |
| 4,069,544 | A * | 1/1978 | D'Hooge | 16/49 |
| 4,815,401 | A * | 3/1989 | Bagnall | 112/80.41 |
| 8,732,904 | B2 * | 5/2014 | Busch | 16/53 |
| 2008/0121490 | A1 * | 5/2008 | Dubach et al. | 192/17 D |

* cited by examiner

*Primary Examiner* — William Kelleher
*Assistant Examiner* — Jude Agendia
(74) *Attorney, Agent, or Firm* — Oblon, McClelland, Maier & Neustadt, L.L.P.

(57) ABSTRACT

A rotary damper includes an actuator including an extension side that is connected to a linkage. The rotary damper includes the linkage, a cam follower, and a cam wheel. The linkage is connected to the cam follower and the cam follower is movable relative to the cam wheel. The cam follower contacts a first portion of the cam wheel when in a locked state. The cam follower contacts a second portion of the cam wheel when a rotational force is applied to the cam wheel and the extension side of the actuator extends to apply an actuator force that counteracts a portion of the rotational force.

19 Claims, 7 Drawing Sheets

ROTARY DAMPER

BACKGROUND OF THE INVENTION

1. Field of the Invention

Embodiments described herein relate generally to a system and method for damping a rotational force of a door as well as holding the door in a locked position. More particularly, embodiments of the present disclosure relate to a system and method for damping the rotational force of the door as well as holding the door in a locked position using a cam wheel, a cam follower, and a actuator.

2. Background

In a machining center, a plurality of different tools may be needed for a given machine to process a work piece. A machine operator may manually rotate a tool loading station in a tool magazine to exchange tools. Heavy tools and use of excessive force by the machine operator may cause a door of the magazine tool loading station to close with too much force. Closing the magazine tool loading station with too much force could cause damage to the machine.

SUMMARY OF THE INVENTION

According to one aspect of the present disclosure, a rotary damper includes an actuator including an extension side that is connected to a linkage. The rotary damper includes the linkage, a cam follower, and a cam wheel. The linkage is connected to the cam follower and the cam follower is movable relative to the cam wheel. The cam follower contacts a first portion of the cam wheel when in a locked state. The cam follower contacts a second portion of the cam wheel when a rotational force is applied to the cam wheel and the extension side of the actuator extends to apply an actuator force that counteracts a portion of the rotational force.

According to another aspect of the present disclosure, the cam follower contacts the second portion of the cam wheel in a floating state.

According to yet another aspect of the present disclosure, the extension side of the actuator is in a most retracted position in the floating state.

According to still another aspect of the present disclosure, a relief regulator controls the actuator force associated with extending the extension side of the actuator.

According to another aspect of the present disclosure, a speed controller controls a speed at which the extension side of the actuator extends.

According to yet another aspect of the present disclosure, the actuator force is proportional to a rotational speed associated with the rotational force.

According to still another aspect of the present disclosure, the first portion of the cam wheel is a curved notch portion.

According to another aspect of the present disclosure, the second portion of the cam wheel is a curved semicircular portion.

According to still another aspect of the present disclosure, the cam wheel does not rotate when the cam follower contacts the first portion of the cam wheel.

According to yet another aspect of the present disclosure, the cam wheel rotates when the cam follower contacts the second portion of the cam wheel.

According to one aspect of the present disclosure, a rotary damper includes an actuator including an extension side that is connected to a linkage. The rotary damper includes the linkage, a cam follower, and a cam wheel. The linkage is connected to the cam follower and the cam follower is movable relative to the cam wheel. The cam follower contacts a first portion of the cam wheel responsive to a first actuator force applied by retracting the extension side of the actuator. The cam follower is moved so as not to contact the cam wheel responsive to a second actuator force applied by extending the extension side of the actuator. The cam follower contacts a second portion of the cam wheel responsive to a third actuator force applied by the actuator.

According to another aspect of the present disclosure, the third actuator force is applied by retracting the extension side of the actuator.

According to yet another aspect of the present disclosure, the third actuator force is applied by extending the extension side of the actuator.

According to still another aspect of the present disclosure, the extension side of the actuator extends responsive to a rotational force applied to the cam wheel.

According to another aspect of the present disclosure, the rotational force is variable.

According to yet another aspect of the present disclosure, a relief regulator controls the third actuator force associated with extending the extension side of the actuator and a speed controller controls a speed at which the extension side of the actuator extends.

According to still another aspect of the present disclosure, the third actuator force is proportional to a rotational speed associated with the rotational force.

According to another aspect of the present disclosure, the first portion of the cam wheel is a curved notch portion.

According to yet another aspect of the present disclosure, the second portion of the cam wheel is a curved semicircular portion.

According to still another aspect of the present disclosure, the cam follower moves along the second portion of the cam wheel responsive to the third actuator.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

Figure 1:
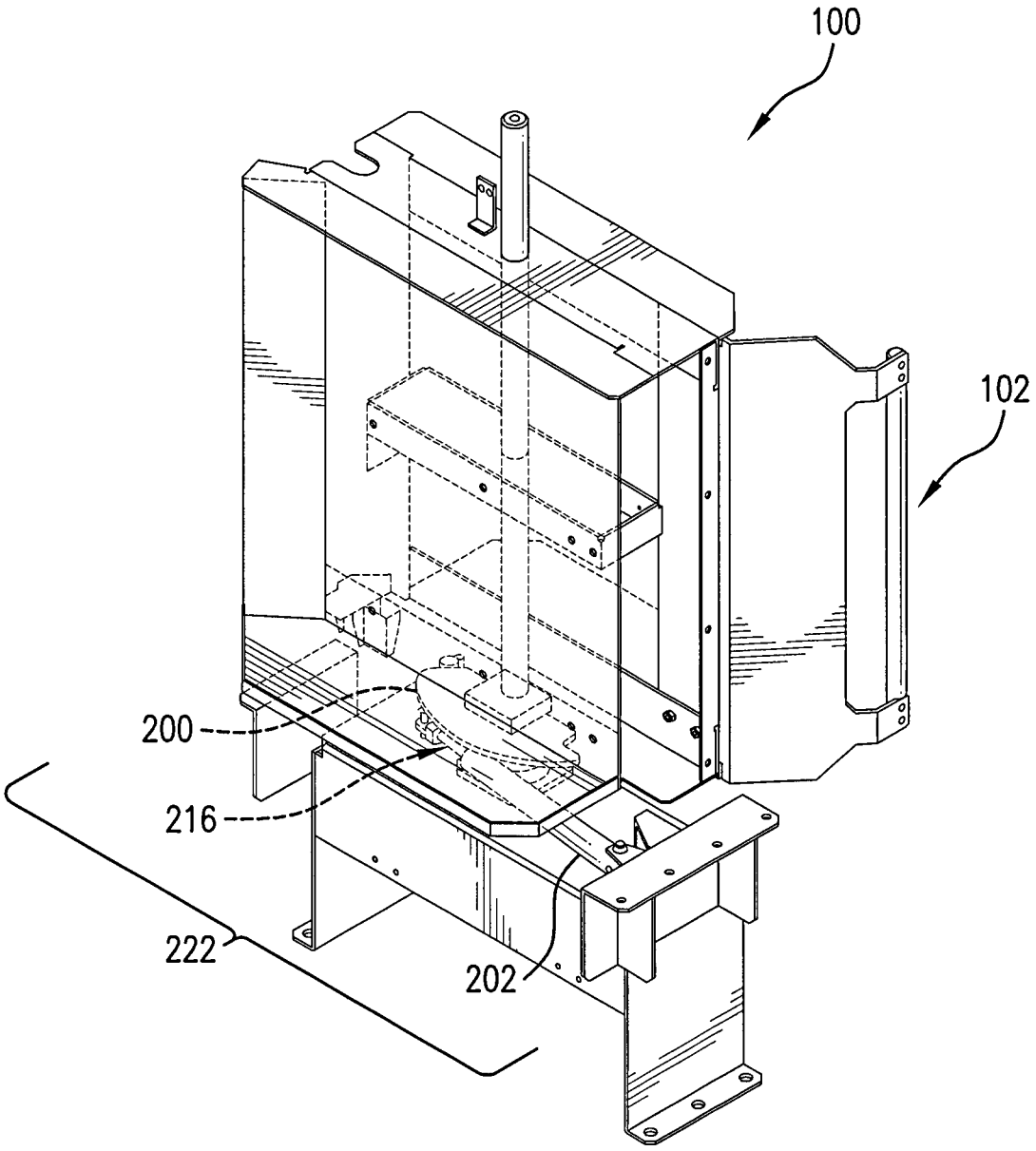
FIG. 1 illustrates an exemplary magazine tool loading station with an exemplary rotary damper.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "program" or "computer program" or similar terms, as used herein, is defined as a sequence of instructions designed for execution on a computer system. A "program", or "computer program", may include a subroutine, a program module, a script, a function, a procedure, an object method, an object implementation, in an executable application, an applet, a servlet, a source code, an object code, a shared library/dynamic load library and/or other sequence of instructions designed for execution on a computer system.

Reference throughout this document to "one embodiment", "certain embodiments", "an embodiment", "an implementation", "an example" or similar terms means that a particular feature, structure, or characteristic described in connection with the embodiment is included in at least one embodiment of the present disclosure. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

FIG. 1 illustrates a magazine tool loading station 100 that includes an exemplary rotary damper 222. The rotary damper 222 is located under the magazine tool loading station 100. The magazine tool loading station 100 is, for example, part of a machine (not shown) that machines a work piece. The magazine tool loading station 100 has a door 102 that rotates up to 180° to allow a machine operator to exchange tools to be used in a machining process. The tools loaded into the machine setup station 100 can be heavy and thus, can result in significant inertial force being applied to the door 102 and the magazine tool loading station 100. Therefore, it is necessary to slow the rotation of the door 102 and to minimize impact force to the magazine tool loading station 100. Further, it is also necessary to retain the magazine tool loading station 100 in a locked position, for example, when a robot or other automated element is exchanging tools between the magazine tool loading station 100 and the machine.

Figure 2:
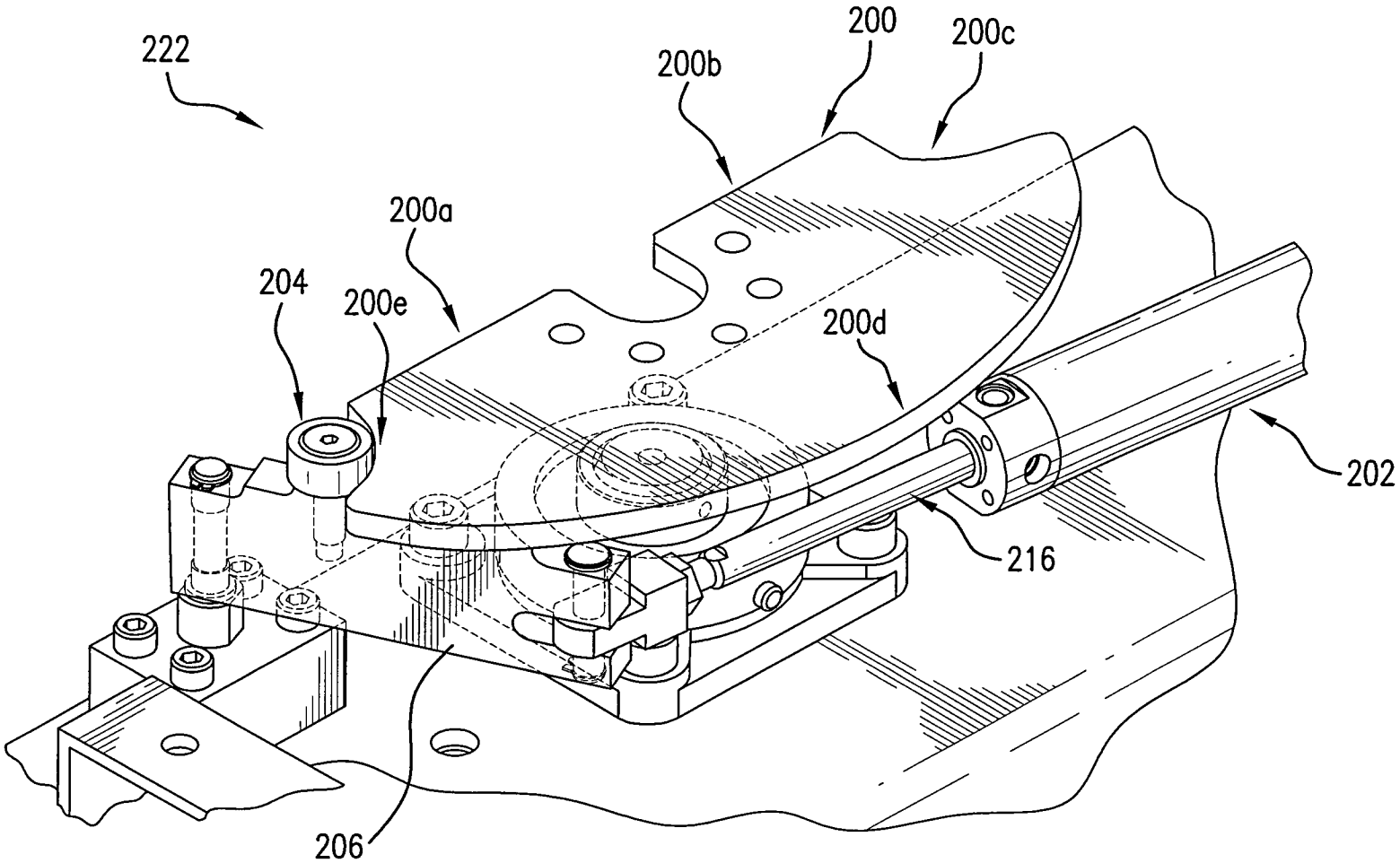
FIG. 2 illustrates a detailed view of the exemplary rotary damper.

FIG. 2 illustrates the exemplary rotary damper 222 in a locked state. The rotary damper 222 includes a cam wheel 200, an actuator 202 that has an extension/retraction side 216, a linkage 206 connected to the extension/retraction side 216 of the actuator 202 and connected to a cam follower 204. The cam wheel 200 has flat surfaces 200*a* and 200*b*, an angled surface 200*c*, a curved semicircular portion 200*d*, and a curved notch portion 200*e*. As will be understood by one of ordinary skill in the art, the actuator is implemented by one or more of the following, but is not limited to: a hydraulic pressurizing/depressurizing device, a pneumatic pressurizing/depressurizing device (e.g., an air cylinder), a mechanical spring, and an electrical actuator.

Engaging the Door in a Locked State

Figure 3:
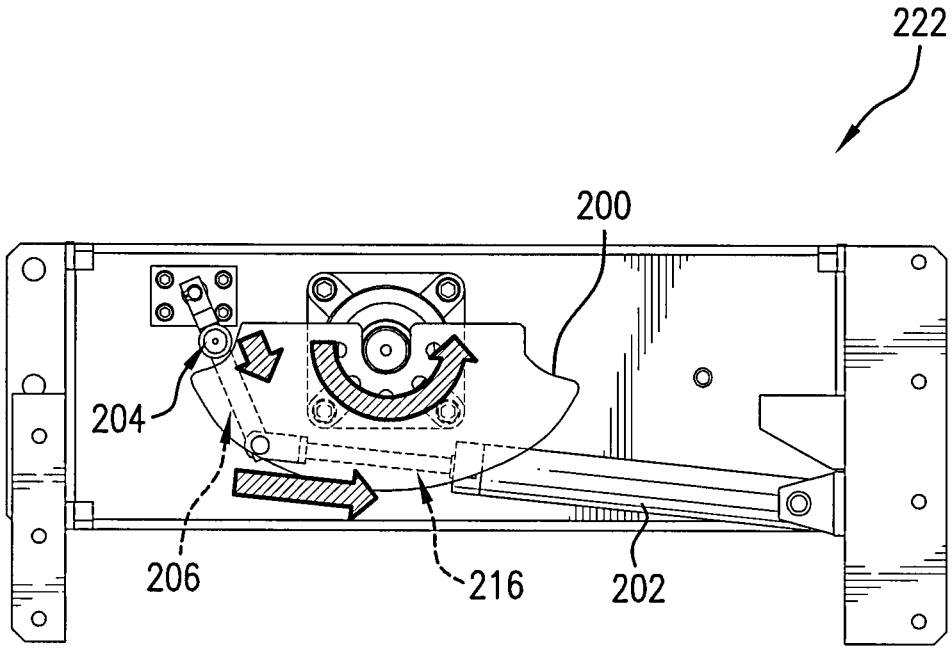
FIG. 3 illustrates the cam wheel of the exemplary rotary damper in a locked state in a 0° position according to certain embodiments of the present disclosure.

In FIG. 3, the cam wheel 200 of the rotary damper 222 is shown at a 0° position in a locked state. When the door 102 of the magazine tool loading station 100 is closed and a lock button (not shown) is engaged, the extension/retraction side 216 of the actuator 202 is retracted, by the actuator 202, and pulls on the linkage 206. The linkage 206, in turn, pulls the cam follower 204 against the curved notch portion 200*e* of the cam wheel 200. A cam follower force supplied by the cam follower 204 acts, in a direction that is normal to the contact point, on the curved notch portion 200*e* of the cam wheel 200. The cam follower force results from an actuator force of the extension/retraction side 216 of the actuator 202 retracting and pulling on the linkage 206. The cam follower force acting on the cam wheel results in a counterclockwise rotational force being applied to the cam wheel 200. In this manner, the door 102 of the magazine tool loading station 100 is engaged in a locked position.

Figure 4:
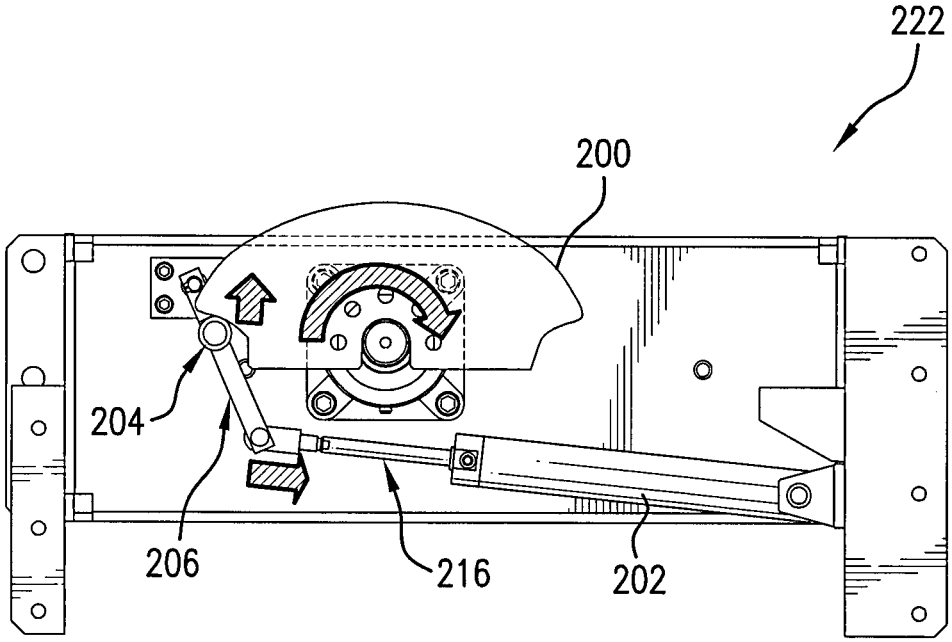
FIG. 4 illustrates the cam wheel of the exemplary rotary damper in a locked state in a 180° position according to certain embodiments of the present disclosure.

In FIG. 4, the cam wheel 200 of the rotary damper 222 is shown at a 180° position in a locked state. In this case, the cam follower force again acts on the curved notch portion 200*e* of the cam wheel 200, but the cam follower force is applied in a different direction such that a clockwise rotational force is applied to the cam wheel 200. As with the 0° position described with respect to FIG. 3, the cam follower force results from the actuator force of the extension/retraction side 216 of the actuator 202 acting on the linkage 206. In this manner, the door 102 of the magazine tool loading station 100 is engaged in a locked position.

Unlocking the Door from the Locked State

Figure 5:
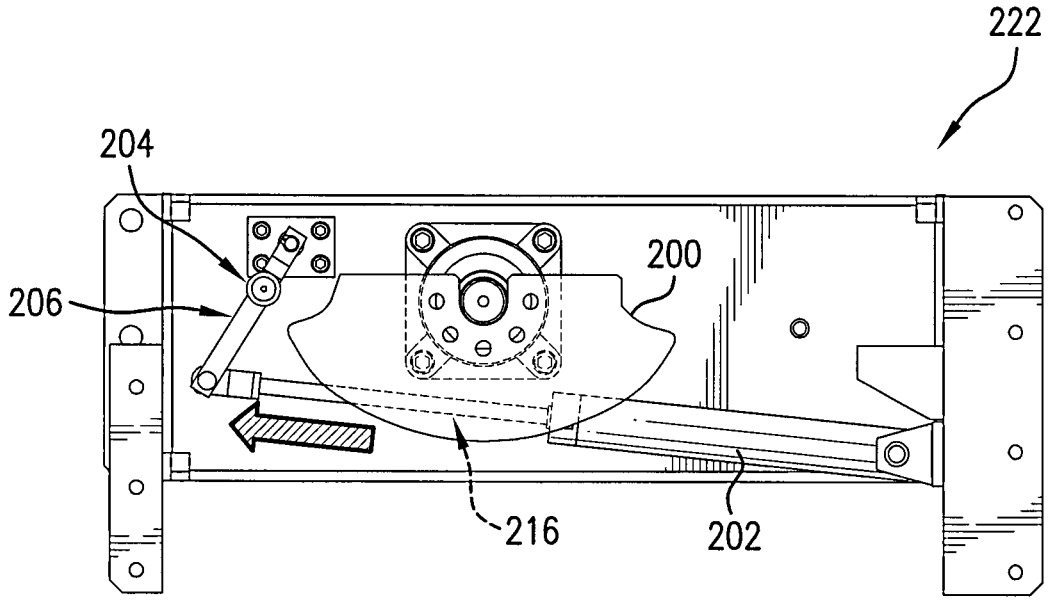
FIG. 5 illustrates the cam wheel of the exemplary rotary damper in an unlocked state which is unlocked from a 0° locked position according to certain embodiments of the present disclosure.

In FIG. 5, the cam wheel 200 of the rotary damper 222 is shown in a 0° position in an unlocked state. When an unlock button (not shown) is pushed, the extension/retraction side 216 of actuator 202 is extended, by the actuator 202, and pushes against the linkage 206. The extension of the extension/retraction side 216 of actuator 202 applies the actuator force to the linkage 206 and pushes the cam follower 204 out from the curved notch portion 200*e* of the cam wheel 200. In this unlocked state, the cam follower 204 does not contact the cam wheel 200. Thus, the magazine tool loading station 100 is unlocked and can be rotated manually by the machine operator.

Figure 6:
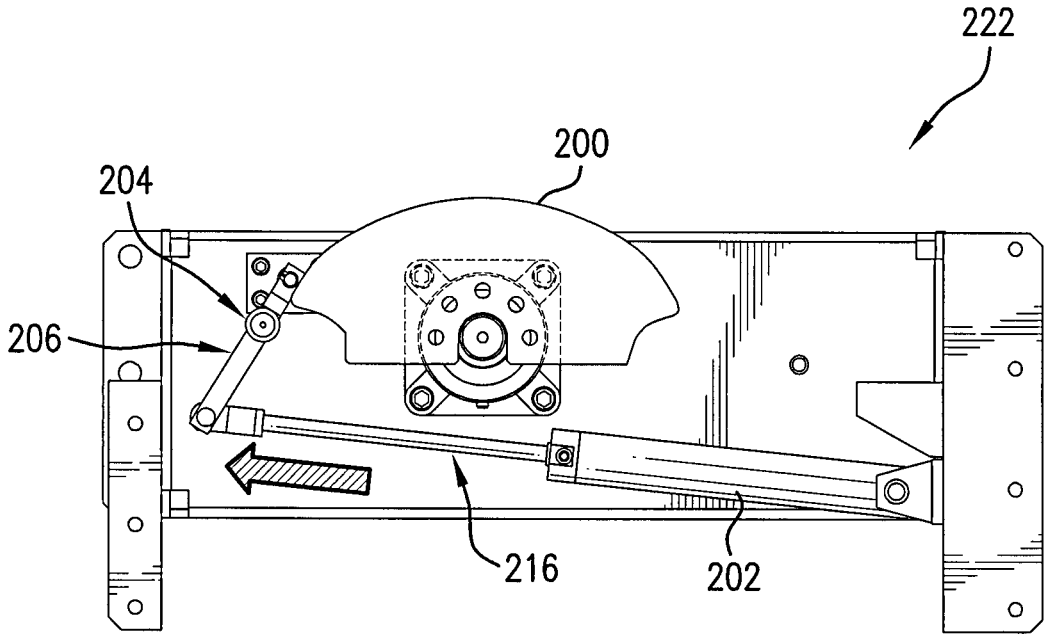
FIG. 6 illustrates the cam wheel of the exemplary rotary damper in an unlocked state and which is unlocked from a 180° locked position according to certain embodiments of the present disclosure.

In FIG. 6, the cam wheel 200 of the rotary damper 222 is shown in a 180° position in an unlocked state. As discussed above with respect to FIG. 5, the extension/retraction side 216 of the actuator 202 is extended, by the actuator 202, and pushes against the linkage 206. The extension of the extension/retraction side 216 of actuator 202 applies the actuator force to the linkage 206 and pushes the cam follower 204 out from the curved notched portion 200*e* of the cam wheel 200. In this unlocked state, the cam follower 204 does not contact the cam wheel 200. Thus, the magazine tool loading station 100 is unlocked and can be rotated manually by the machine operator.

Floating State of the Rotary Damper

Figure 7:
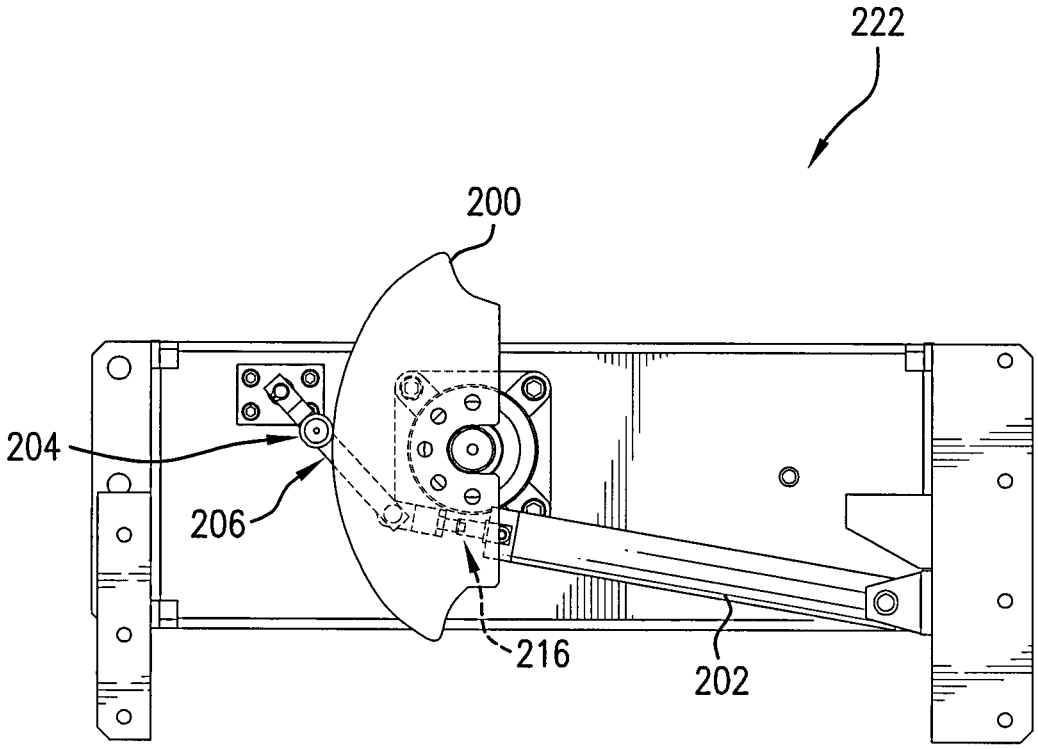
FIG. 7 illustrates the cam wheel of the exemplary rotary damper in a floating state in a 90° position according to certain embodiments of the present disclosure.

FIG. 7 illustrates the cam wheel 200 of the rotary damper 222 in a 90° position in a floating state. In one embodiment, the rotary damper 222 enters the floating state when the cam wheel 200 is in a 90° position. In another embodiment, when the rotary damper 222 is in an unlocked state, the machine operator begins to rotate the door 102 of the magazine tool loading station 100 and a timer (not shown) is started. Once a time period specified by the timer has elapsed, the actuator 202 switches to a floating state. In one embodiment, the time period specified by the timer is user-specified.

In the floating state, the extension/retraction side 216 of the actuator 202 retracts, which results in the actuator force acting on the linkage 206. The linkage 206 in turn acts on the cam follower 204 to bring the cam follower 204 into contact with the curved semicircular portion 200*d* of the cam wheel 200. The actuator force is sufficient to maintain contact between the cam follower 204 and the curved semicircular portion 200*d* of the cam wheel 200. When the door 102 of the magazine tool loading station 100 is rotated to a 90° position, and correspondingly, when the cam wheel 200 of the rotary damper 222 is rotated to the 90° position, the extension/retraction side 216 of the actuator 202 is in a most retracted position.

Damping Rotational Force of the Door

Figure 8A:
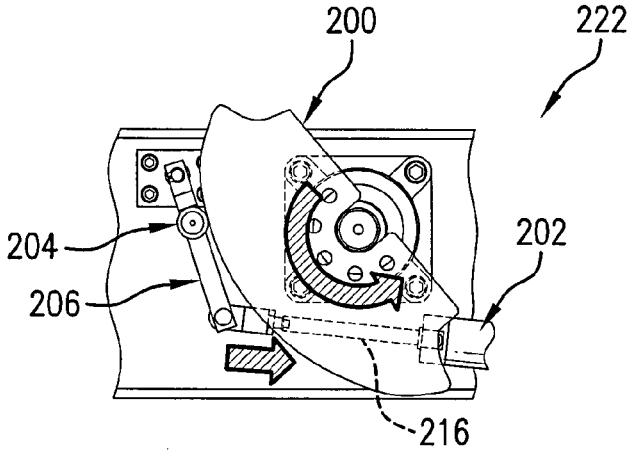
FIG. 8A illustrates an exemplary position of the exemplary rotary damper during a damping operation.

In FIG. 8A, at the start of a damping operation, the cam follower 204 is in contact with the curved semicircular portion 200*d* of the cam wheel 200. The cam wheel 200 is shown as being beyond the 90° position. In this case, when the door 102 of the magazine tool loading station 100 passes the 90° position, the extension/retraction side 216 of the actuator 202 starts to extend because the curved semicircular portion 200*d* of the cam wheel 200 is pushing on the cam follower 204. This results in a counterclockwise rotational force opposing and proportional to the rotation being applied to the cam wheel 200.

In the damping operation, a relief regulator (not shown) controls the actuator force associated with extending the extension/retraction side 216 of the actuator 202. The extension/retraction side 216 of the actuator 202 extends at a speed controlled by a speed controller. The speed controller restricts the speed at which the extension/retraction side 216 of the actuator 202 extends in proportion with the amount of rotational force being applied to the door 102 of the magazine tool loading station 100, and thus the rotary damper 222. The relief regulator and the speed controller thus counteract the rotational force on the door 102 applied, for example, by the machine operator or the robot. Accordingly, the door 102 of the magazine tool loading station 100 is prevented from being closed excessively fast and with excessive force.

Figure 8B:
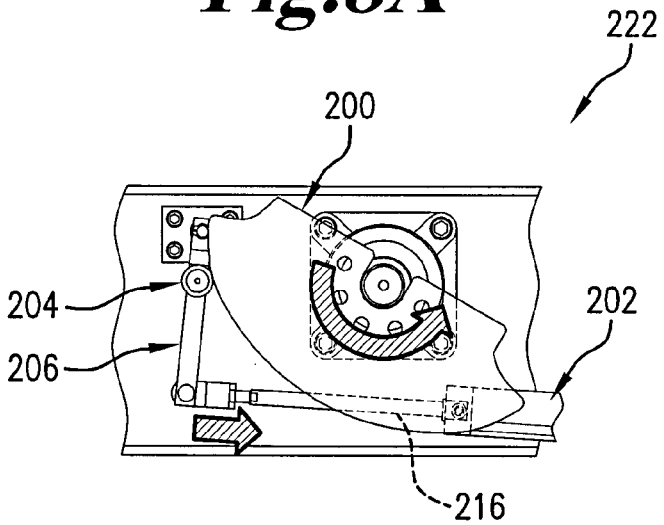
FIG. 8B illustrates an exemplary position of the exemplary rotary damper during a damping operation.

As the extension/retraction side 216 of the actuator 202 extends, the extension/retraction side 216 of the actuator 202 pulls on the linkage 206, which pulls the cam follower 204 along the curved semicircular portion 200*d* of the cam wheel 200. FIG. 8B shows the extension/retraction side 216 of the actuator 202 extending farther as the cam wheel 200 rotates and the cam follower 204 is pushed by the curved semicircular portion 200*d* of the cam wheel 200.

Figure 8C:
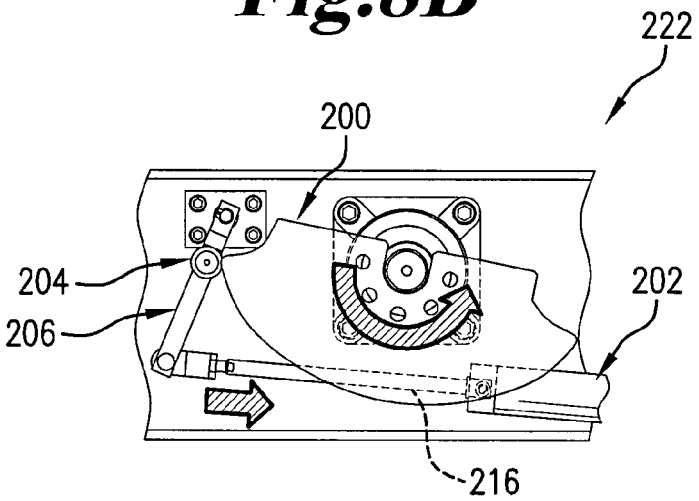
FIG. 8C illustrates an exemplary position of the exemplary rotary damper during a damping operation.

FIG. 8C shows the extension/retraction side 216 of the actuator 202 extending by a furthest amount just prior to entering the locked state in the 0° position, as the cam wheel 200 rotates and the cam follower 204 is pushed by the curved semicircular portion 200*d* of the cam wheel 200.

Figure 8D:
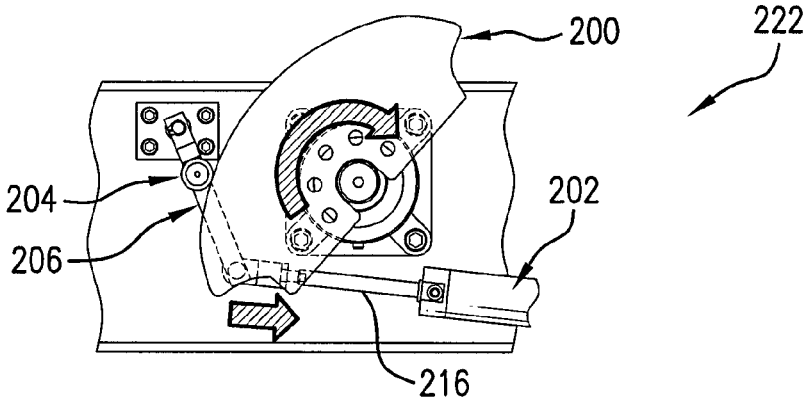
FIG. 8D illustrates an exemplary position of the exemplary rotary damper during a damping operation.

FIG. 8D shows the cam wheel 200 is shown as being beyond the 90° position. In this case, when the door 102 of the magazine tool loading station 100 passes the 90° position, the extension/retraction side 216 of the actuator 202 starts to extend because the curved semicircular portion 200*d* of the cam wheel 200 is pushing on the cam follower 204. This results in a clockwise rotational force opposing and proportional to the rotation being applied to the cam wheel 200.

As discussed above with respect to FIGS. 8A-8C, in the damping operation, a relief regulator (not shown) controls the actuator force associated with extending the extension/retraction side 216 of the actuator 202. The extension/retraction side 216 of the actuator 202 extends at a speed controlled by a speed controller. The speed controller restricts the speed at which the extension/retraction side 216 of the actuator 202 extends in proportion with the amount of rotational force being applied to the door 102 of the magazine tool loading station 100, and thus the rotary damper 222. The relief regulator and the speed controller thus counteract the rotational force on the door 102 applied, for example, by the machine operator or the robot. Accordingly, the door 102 of the magazine tool loading station 100 is prevented from being closed excessively fast and with excessive force.

Figure 8E:
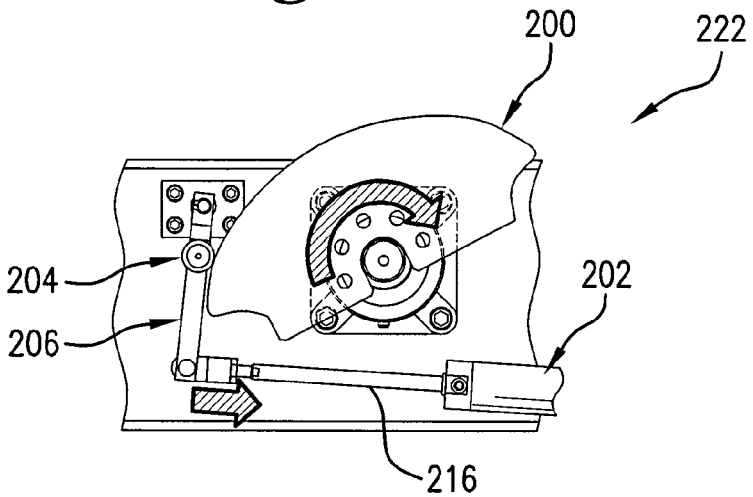
FIG. 8E illustrates an exemplary position of the exemplary rotary damper during a damping operation.

FIG. 8E shows the extension/retraction side 216 of the actuator 202 extending farther as the cam wheel 200 rotates and the cam follower 204 is pushed by the curved semicircular portion 200*d* of the cam wheel 200.

Figure 8F:
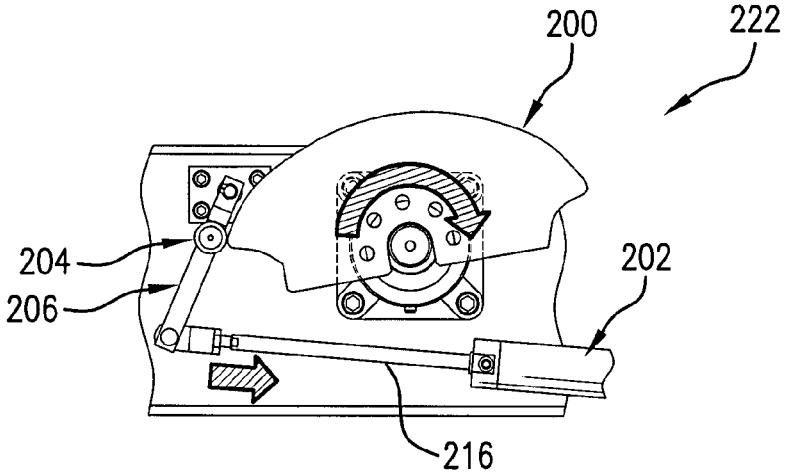
FIG. 8F illustrates an exemplary position of the exemplary rotary damper during a damping operation.

FIG. 8F shows the extension/retraction side 216 of the actuator 202 extending by a furthest amount just prior to entering the locked state at the 180° position, as the cam wheel 200 rotates and the cam follower 204 is pushed by the curved semicircular portion 200*d* of the cam wheel 200.

In one embodiment, the speed control and relief regulator controls application of a range of actuator forces. Thus, the exemplary rotary damper 222 provides an actuator force for a damping operation with respect to a variable rotational force applied to a door, as well as a locking mechanism for the door.

Those skilled in the art will recognize, upon consideration of the above teachings, that certain of the above exemplary embodiments, for example using the timer, are based upon use of a programmed processor. However, embodiments of the present disclosure are not limited to such exemplary embodiments, since other embodiments could be implemented using hardware component equivalents such as special purpose hardware and/or dedicated processors. Similarly, general purpose computers, microprocessor based computers, micro-controllers, optical computers, analog computers, dedicated processors, application specific circuits and/or dedicated hard wired logic may be used to construct alternative equivalent embodiments.

Those skilled in the art will appreciate, upon consideration of the above teachings, that the operations and processes, such as those by the timer, and associated data used to implement certain of the embodiments described above can be implemented using disc storage as well as other forms of storage such as non-transitory storage devices including as for example Read Only Memory (ROM) devices, Random Access Memory (RAM) devices, network memory devices, optical storage elements, magnetic storage elements, magneto-optical storage elements, flash memory, core memory and/or other equivalent volatile and non-volatile storage technologies without departing from certain embodiments of the present disclosure. The term non-transitory does not suggest that information cannot be lost by virtue of removal of power or other actions. Such alternative storage devices should be considered equivalents.

Certain embodiments described herein, are or may be implemented using one or more programmed processors executing programming instructions that are broadly described above in flow chart form that can be stored on any suitable electronic or computer readable storage medium. However, those skilled in the art will appreciate, upon consideration of the present disclosure, that the processes described above can be implemented in any number of variations and in many suitable programming languages without departing from embodiments of the present disclosure. For example, the order of certain operations carried out can often be varied, additional operations can be added or operations can be deleted without departing from certain embodiments of the disclosure. Such variations are contemplated and considered equivalent.

While certain illustrative embodiments have been described, it is evident that many alternatives, modifications, permutations and variations will become apparent to those skilled in the art in light of the foregoing description.

The invention claimed is:

1. A rotary damper, comprising:

an actuator including an extension side that is extendable with respect to the actuator and is connected to a linkage;

the linkage, which is connected to a cam follower;

the cam follower, which is movable relative to a cam wheel; and the cam wheel, wherein the cam follower contacts a first portion of the cam wheel when in a locked state, the cam follower moves along a second portion of the cam wheel when a rotational force is applied to the cam wheel and the extension side of the actuator extends to apply an actuator force that counteracts a portion of the rotational force.

2. The rotary damper according to claim 1, wherein the cam follower contacts the second portion of the cam wheel in a floating state.

3. The rotary damper according to claim 2, wherein the extension side of the actuator is in a most retracted position in the floating state.

4. The rotary damper according to claim 1, further comprising:

a relief regulator that controls the actuator force associated with extending the extension side of the actuator.

5. The rotary damper according to claim 4, further comprising:

a speed controller that controls a speed at which the extension side of the actuator extends.

6. The rotary damper according to claim 1, wherein the actuator force is proportional to a rotational speed associated with the rotational force.

7. The rotary damper according to claim 1, wherein the first portion of the cam wheel is a curved notch portion.

8. The rotary damper according to claim 1, wherein the second portion of the cam wheel is a curved semicircular portion.

9. The rotary damper according to claim 1, wherein the cam wheel does not rotate when the cam follower contacts the first portion of the cam wheel.

10. The rotary damper according to claim 1, wherein the cam wheel rotates when the cam follower contacts the second portion of the cam wheel.

11. A rotary damper, comprising:

an actuator including an extension side that is extendable with respect to the actuator and is connected to a linkage;

the linkage, which is connected to a cam follower;

the cam follower, which is movable relative to a cam wheel; and the cam wheel, wherein the cam follower contacts a first portion of the cam wheel responsive to a first actuator force applied by retracting the extension side of the actuator, the cam follower is moved so as not to contact the cam wheel responsive to a second actuator force applied by extending the extension side of the actuator, and the cam follower moves along a second portion of the cam wheel responsive to a third actuator force applied by the actuator.

12. The rotary damper according to claim 11, wherein the third actuator force is applied by retracting the extension side of the actuator.

13. The rotary damper according to claim 11, wherein the third actuator force is applied by extending the extension side of the actuator.

14. The rotary damper according to claim 13, wherein the extension side of the actuator extends responsive to a rotational force applied to the cam wheel.

15. The rotary damper according to claim 14, wherein the rotational force is variable.

16. The rotary damper according to claim 14, further comprising:

a relief regulator that controls the third actuator force associated with extending the extension side of the actuator; and a speed controller that controls a speed at which the extension side of the actuator extends.

17. The rotary damper according to claim 14, wherein the third actuator force is proportional to a rotational speed associated with the rotational force.

18. The rotary damper according to claim 11, wherein the first portion of the cam wheel is a curved notch portion.

19. The rotary damper according to claim 11, wherein the second portion of the cam wheel is a curved semicircular portion.

* * * * *